US008371388B2

(12) United States Patent
Moeller et al.

(10) Patent No.: US 8,371,388 B2
(45) Date of Patent: Feb. 12, 2013

(54) APPARATUS AND METHOD FOR INSTALLING A LINER STRING IN A WELLBORE CASING

(75) Inventors: Daniel Keith Moeller, Celina, TX (US); Brock Wayne Watson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 459 days.

(21) Appl. No.: 12/632,887

(22) Filed: Dec. 8, 2009

(65) Prior Publication Data

US 2011/0132622 A1 Jun. 9, 2011

(51) Int. Cl.
*E21B 43/10* (2006.01)

(52) U.S. Cl. ..... 166/382; 166/207

(58) Field of Classification Search ..... 166/380, 166/382, 206–208
See application file for complete search history.

(56) References Cited

U.S. PATENT DOCUMENTS 3,598,184 A * 8/1971 Schuh ..... 166/302
5,325,923 A 7/1994 Surjaatmadja et al.
5,396,957 A 3/1995 Surjaatmadja et al.
6,135,208 A 10/2000 Gano et al.
6,189,616 B1 2/2001 Gano et al.
6,263,966 B1 7/2001 Haut et al.
6,283,156 B1 9/2001 Motley
6,412,565 B1 7/2002 Castano-Mears
6,415,509 B1 7/2002 Echols et al.
6,457,518 B1 10/2002 Castano-Mears et al.
6,478,091 B1 11/2002 Gano
6,543,545 B1 4/2003 Chatterji et al.
6,695,050 B2 2/2004 Winslow et al.
6,695,051 B2 2/2004 Smith et al.
6,722,433 B2 4/2004 Brothers et al.
6,725,918 B2 4/2004 Gano
6,766,862 B2 7/2004 Chatterji et al.
6,772,841 B2 8/2004 Gano
6,854,522 B2 2/2005 Brezinski et al.
6,941,652 B2 9/2005 Echols et al.
6,994,170 B2 2/2006 Echols
7,040,404 B2 5/2006 Brothers et al.
7,048,048 B2 5/2006 Nguyen et al.
7,108,062 B2 9/2006 Castano-Mears et al.
7,152,687 B2 12/2006 Gano
7,204,316 B2 4/2007 Dusterhoft et al.
7,213,647 B2 5/2007 Brothers et al.
7,252,142 B2 8/2007 Brezinski et al.
(Continued)

OTHER PUBLICATIONS

International Search Report and Written Opinion, PCT/US2010/049943, Apr. 28, 2011.

(Continued)

*Primary Examiner* — David Andrews
(74) *Attorney, Agent, or Firm* — Lawrence R. Youst

(57) ABSTRACT

An apparatus (100) for installing a liner string (102) in a wellbore casing (40). The apparatus (100) includes a tubular mandrel subassembly (110), a load transfer subassembly (140) and an expander cone subassembly (142). The load transfer subassembly (140) is carried on the tubular mandrel subassembly (110) and is operable to apply a force in the downhole direction to the liner string (102). The expander cone subassembly (142) is carried on the tubular mandrel subassembly (110) and is operable to radially expand at least a portion of the liner string (102) into contact with the wellbore casing (40) when axially moved through the liner string (102). In operation, decoupling of the load transfer subassembly (140) from the tubular mandrel subassembly (110) enables release of the apparatus (100) from the liner string (102).

20 Claims, 13 Drawing Sheets

U.S. PATENT DOCUMENTS

| | | | |
|---|---|---|---|
| 7,264,047 | B2 | 9/2007 | Brezinski et al. |
| 7,275,598 | B2 | 10/2007 | Steele |
| 7,299,882 | B2 | 11/2007 | Brezinski et al. |
| 7,320,367 | B2 | 1/2008 | Brezinski et al. |
| 7,363,986 | B2 | 4/2008 | Brezinski et al. |
| 7,404,437 | B2 | 7/2008 | Brezinski et al. |
| 7,434,616 | B2 | 10/2008 | Echols |
| 2002/0129935 | A1 | 9/2002 | Castano-Mears et al. |
| 2004/0060695 | A1 | 4/2004 | Castano-Mears et al. |
| 2005/0039916 | A1 | 2/2005 | Schultz et al. |
| 2005/0263292 | A1 | 12/2005 | Braddick |
| 2007/0114016 | A1 | 5/2007 | Brezinski et al. |
| 2007/0114017 | A1 | 5/2007 | Brezinski et al. |
| 2007/0114018 | A1 | 5/2007 | Brezinski et al. |
| 2007/0114019 | A1 | 5/2007 | Brezinski et al. |
| 2007/0114044 | A1 | 5/2007 | Brezinski et al. |
| 2007/0267201 | A1 | 11/2007 | Brezinski et al. |
| 2008/0251250 | A1 | 10/2008 | Brezinski et al. |
| 2008/0257560 | A1 | 10/2008 | Brisco et al. |
| 2009/0200041 | A1 | 8/2009 | Watson |
| 2010/0155084 | A1 | 6/2010 | Watson et al. |

OTHER PUBLICATIONS

TIW Corporation, "TIW XPak Drill Down Liner System" downloaded from http://www.tiwtools.com on Nov. 23, 2009, file properties indicate 2005 creation (10 pages).

Baker Hughes, "INLine™ Liner Hanger Packer System" copyright 2006 (4 pages).

Halliburton, "Technical Marketing Document—VersaFlex Liner Systems" Jul. 2009 (26 pages).

Halliburton, "VersaFlex® Expandable Liner System" HES Completions Solutions catalog, pp. 5-1-5-18, Dec. 2008.

Halliburton, "VersaFlex Liner Hanger System", presentation, Sep. 2008 (19 pages).

Halliburton, "VersaFlex Liner Hanger System", presentation, Oct. 2008 (14 pages).

Baker Hughes, "Open Hole Completion Systems" Product reference Guide, copyright 2004 (95 pages).

Baker Hughes, "TORXS New Generation Expandable Liner Hanger System" copyright 2008 (6 pages).

* cited by examiner

APPARATUS AND METHOD FOR INSTALLING A LINER STRING IN A WELLBORE CASING

FIELD OF THE INVENTION

This invention relates, in general, to equipment utilized in conjunction with operations performed in subterranean wells and, in particular, to an apparatus and method for installing a liner string in a subterranean wellbore having a casing string previously installed therein.

BACKGROUND OF THE INVENTION

Without limiting the scope of the present invention, its background is described with reference to constructing a subterranean well, as an example.

In conventional practice, the drilling of an oil or gas well involves creating a wellbore that traverses numerous subterranean formations. For a variety reasons, each of the formations through which the well passes is preferably sealed. For example, it is important to avoid an undesirable passage of formation fluids, gases or materials out of the formation and into the wellbore or for wellbore fluids to enter the formation. In addition, it is commonly desired to isolate producing formations from nonproducing formations to avoid contaminating one formation with the fluids from another formation.

To avoid these problems, conventional well architecture includes the installation of casing within the wellbore. In addition to providing the sealing function, the casing also provides wellbore stability to counteract the geomechanics of the formation such as compaction forces, seismic forces and tectonic forces, thereby preventing the collapse of the wellbore wall. In standard practice, each succeeding casing string placed in the wellbore has an outside diameter having a reduced size when compared to the previously installed casing string. Specifically, the wellbore is drilled in intervals whereby a casing, which is to be installed in a lower wellbore interval, must be passed through the previously installed casing string in an upper wellbore interval.

The casings are generally fixed within the wellbore by a cement layer between the outer wall of the casing and the wall of the wellbore. During the drilling of the wellbore, annuli are provided between the outer surfaces of the casings and the wellbore wall. When a casing string is located in its desired position in the well, a cement slurry is pumped via the interior of the casing, around the lower end of the casing and upwards into the annulus. As soon as the annulus around the casing is sufficiently filled with the cement slurry, the cement slurry is allowed to harden. The cement sets up in the annulus, supporting and positioning the casing and forming a substantially impermeable barrier which divides the wellbore into subterranean zones.

In one approach, each casing string extends downhole from the surface such that only a lower section of each casing string is adjacent to the wellbore wall. Alternatively, the wellbore casings may include one or more liner strings which do not extend to the surface of the wellbore but instead typically extend from near the bottom end of a previously installed casing downward into the uncased portion of the wellbore. Liner strings are typically lowered downhole on a work string that may include a running tool that attaches to the liner string. The liner string typically includes a liner hanger at its uphole end that is mechanically or hydraulically set. In one example, an expander cone is passed through the liner hanger to radially expand and plastically deform the liner hanger into sealing and gripping engagement with the previously installed casing string.

Preferably, the liner string is set or suspended by the liner hanger at a location in the wellbore so that the downhole end of the liner string extends to close proximity of the bottom of the wellbore. It has been found, however, that in certain wellbores such as deviated wellbores, horizontal wellbores, multilateral wellbores and the like, significant force is required to work the liner string to the bottom of the wellbore. Use of such significant force has resulted in certain liner hangers becoming prematurely set within the previously installed casing string when the lower end of the liner string is still remote from the bottom of the wellbore. Accordingly, a need has arisen for a setting tool that is operable to deliver the required force to work the liner string to the bottom of the wellbore without prematurely setting the liner hanger in the previously installed casing string.

SUMMARY OF THE INVENTION

The present invention disclosed herein is directed to an apparatus and method for installing a liner string in a subterranean wellbore having a casing string previously installed therein. The apparatus and method of the present invention utilize a setting tool that is operable to deliver the required force to work the liner string to the bottom of the wellbore without prematurely setting the liner hanger in the previously installed casing string.

In one aspect, the present invention is directed to a method for installing a liner string in a wellbore casing. The method includes positioning a setting tool having an expansion cone subassembly and a load transfer subassembly within the liner string, lowering the setting tool and the liner string into the wellbore casing, applying a force in the downhole direction to the liner string with the load transfer subassembly, axially moving the expansion cone subassembly through the liner string to radially expand at least a portion of the liner string into contact with the wellbore casing and decoupling the load transfer subassembly from the setting tool.

In the method, applying the force in the downhole direction to the liner string may be accomplished with a ring operably associated with the setting tool, with a sleeve operably associated with the setting tool or with a collet subassembly operably associated with the setting tool. Also, in the method, decoupling the load transfer subassembly from the setting tool may be accomplished by shearing a plurality of threads coupling the load transfer subassembly to the setting tool, shearing a plurality of pins coupling the load transfer subassembly to the setting tool, shearing a sleeve operably positioned between the setting tool and the liner string or rotating a slotted assembly. In addition, the method may include axially moving the expansion cone subassembly through the liner string to radially expand a liner hanger into contact with the wellbore casing.

In another aspect, the present invention is directed to an apparatus for installing a liner string in a wellbore casing. The apparatus includes a tubular mandrel subassembly, a load transfer subassembly carried on the tubular mandrel subassembly and operable to apply a force in the downhole direction to the liner string and an expander cone subassembly carried on the tubular mandrel subassembly and operable to radially expand at least a portion of the liner string into contact with the wellbore casing when axially moved through the liner string. In operation, decoupling of the load transfer subassembly from the tubular mandrel subassembly enables release of the apparatus from the liner string.

In one embodiment, the load transfer subassembly may be a ring shearably coupled to the tubular mandrel subassembly by shearable threads, a plurality of shear pins or the like. In another embodiment, the load transfer subassembly may be a shearable sleeve operably positionable between the tubular mandrel subassembly and the liner string. In a further embodiment, the load transfer subassembly may include a collet subassembly.

In a further aspect, the present invention is directed to a method for installing a liner string in a wellbore casing. The method includes positioning a setting tool having a load transfer subassembly within the liner string, lowering the setting tool and the liner string into the wellbore casing, applying a force in the downhole direction to the liner string with the load transfer subassembly and decoupling the load transfer subassembly from the setting tool.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
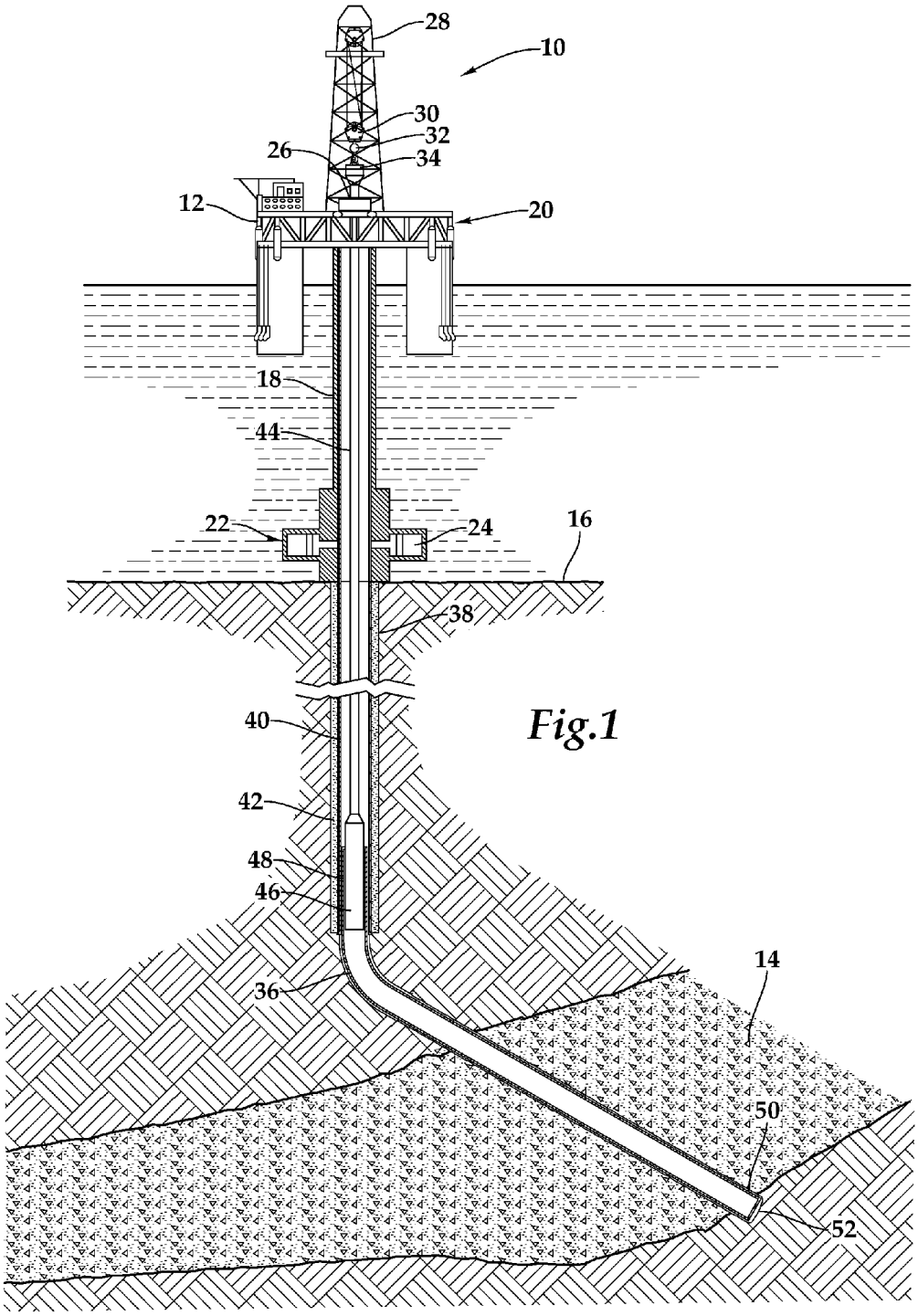
FIG. 1 is a schematic illustration of an offshore oil and gas platform operating an apparatus for installing a liner string in a casing string previously installed in a subterranean wellbore according to an embodiment of the present invention.
Figure 2A:
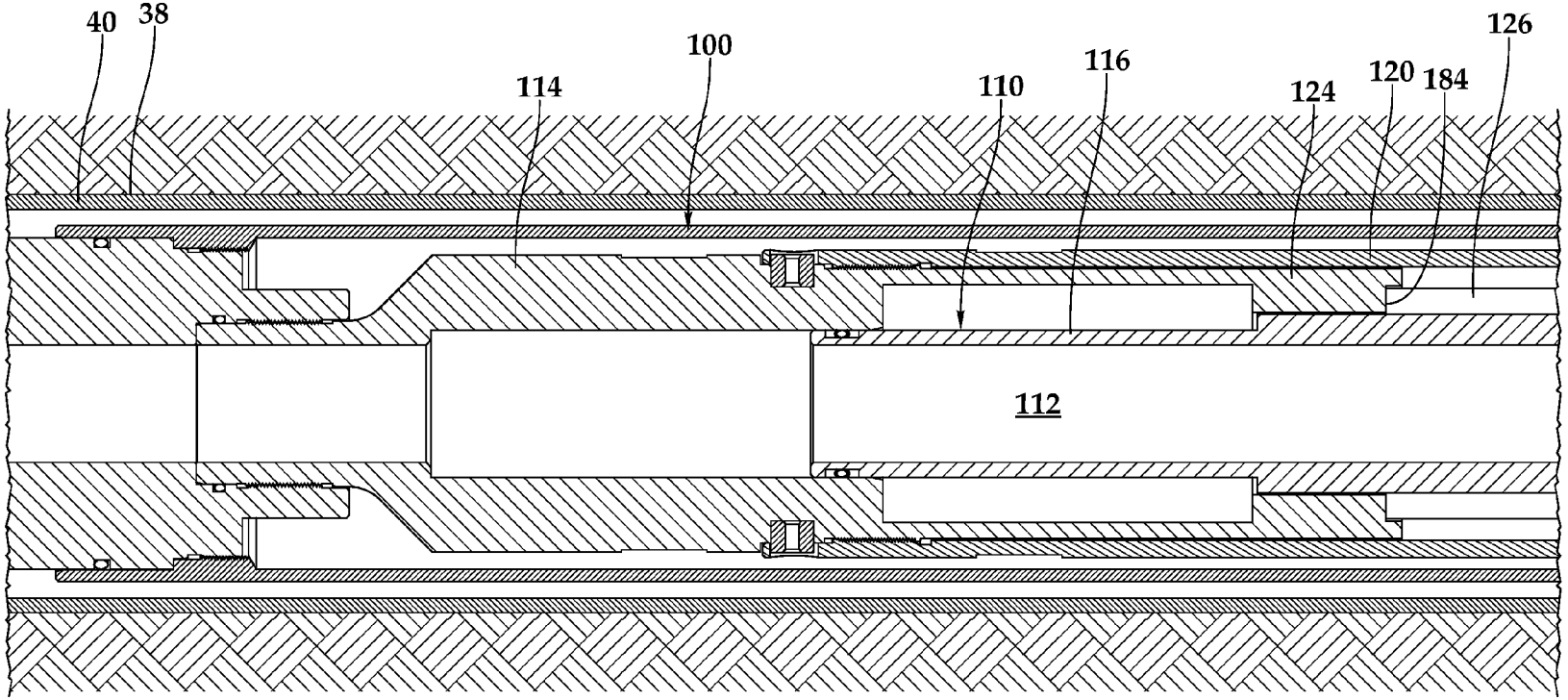
FIGS. 2A-2H are cross sectional views of consecutive axial sections of an apparatus for installing a liner string in a casing string previously installed in a subterranean wellbore according to an embodiment of the present invention.
Figure 2B:
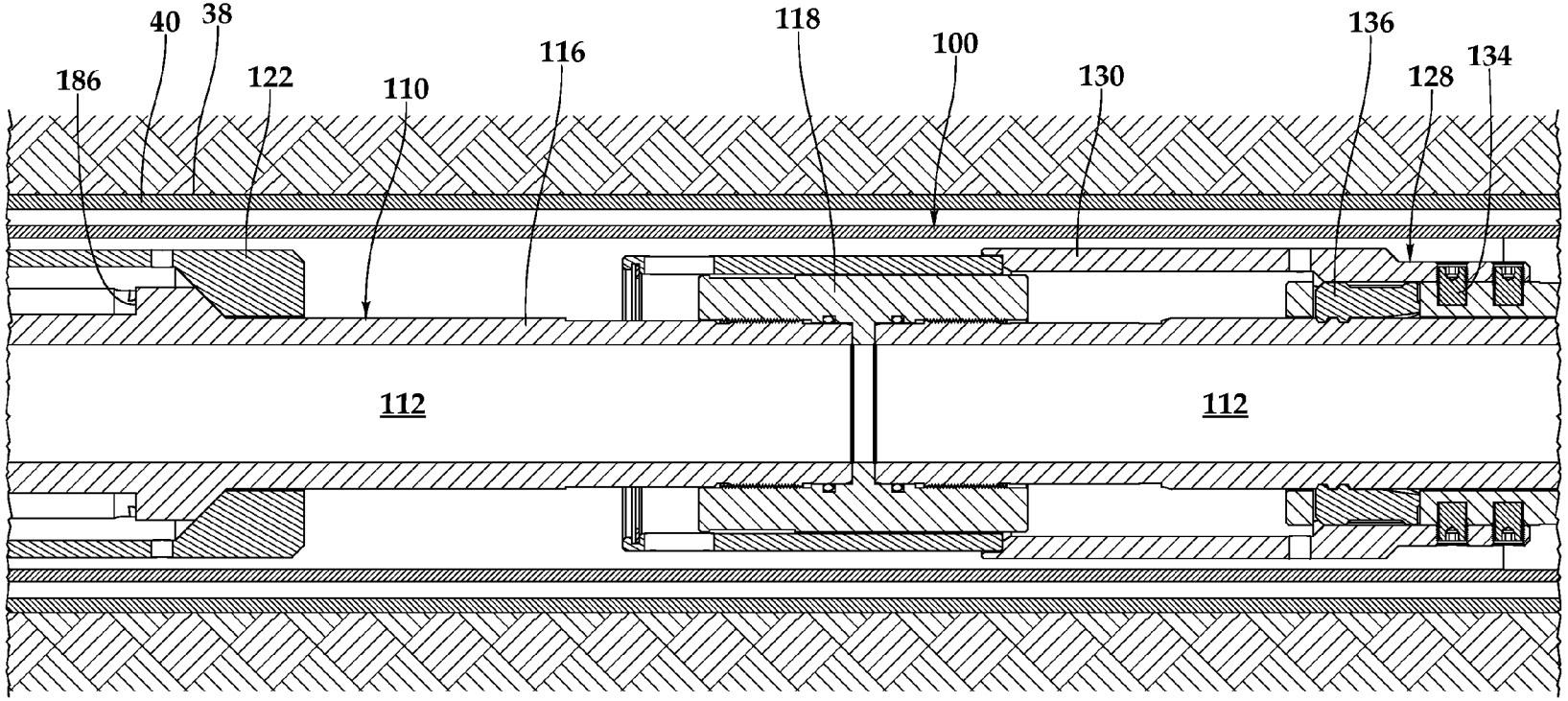
Figure 2C:
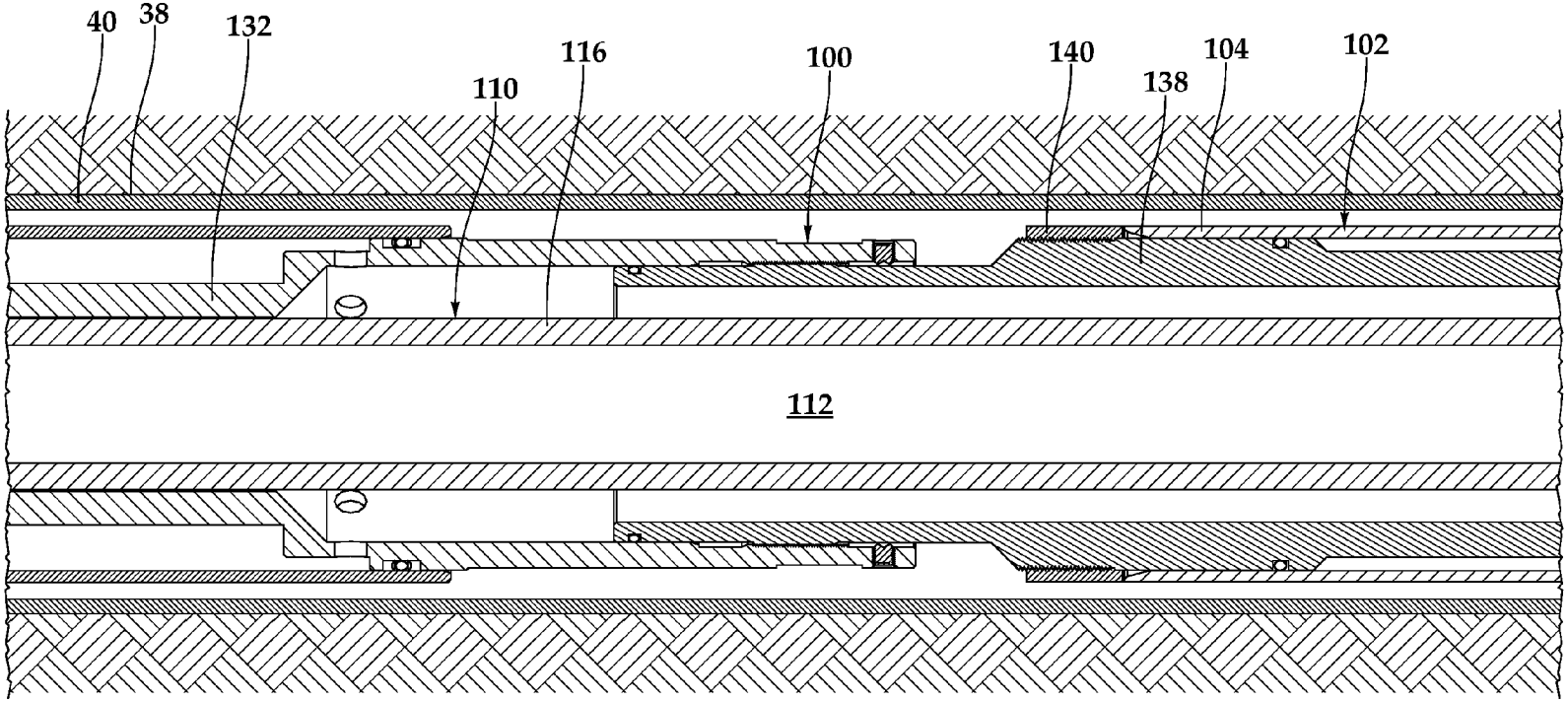
Figure 2D:
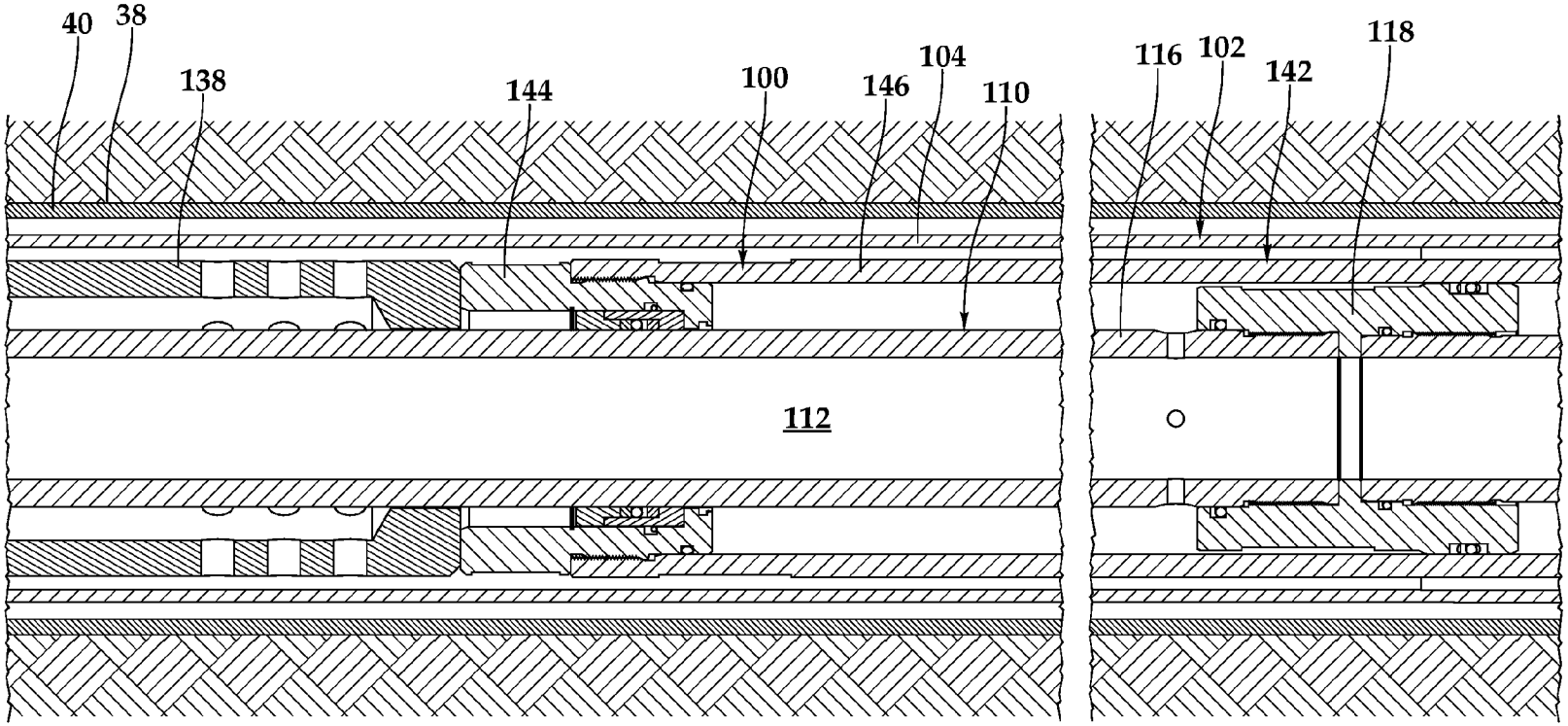
Figure 2E:
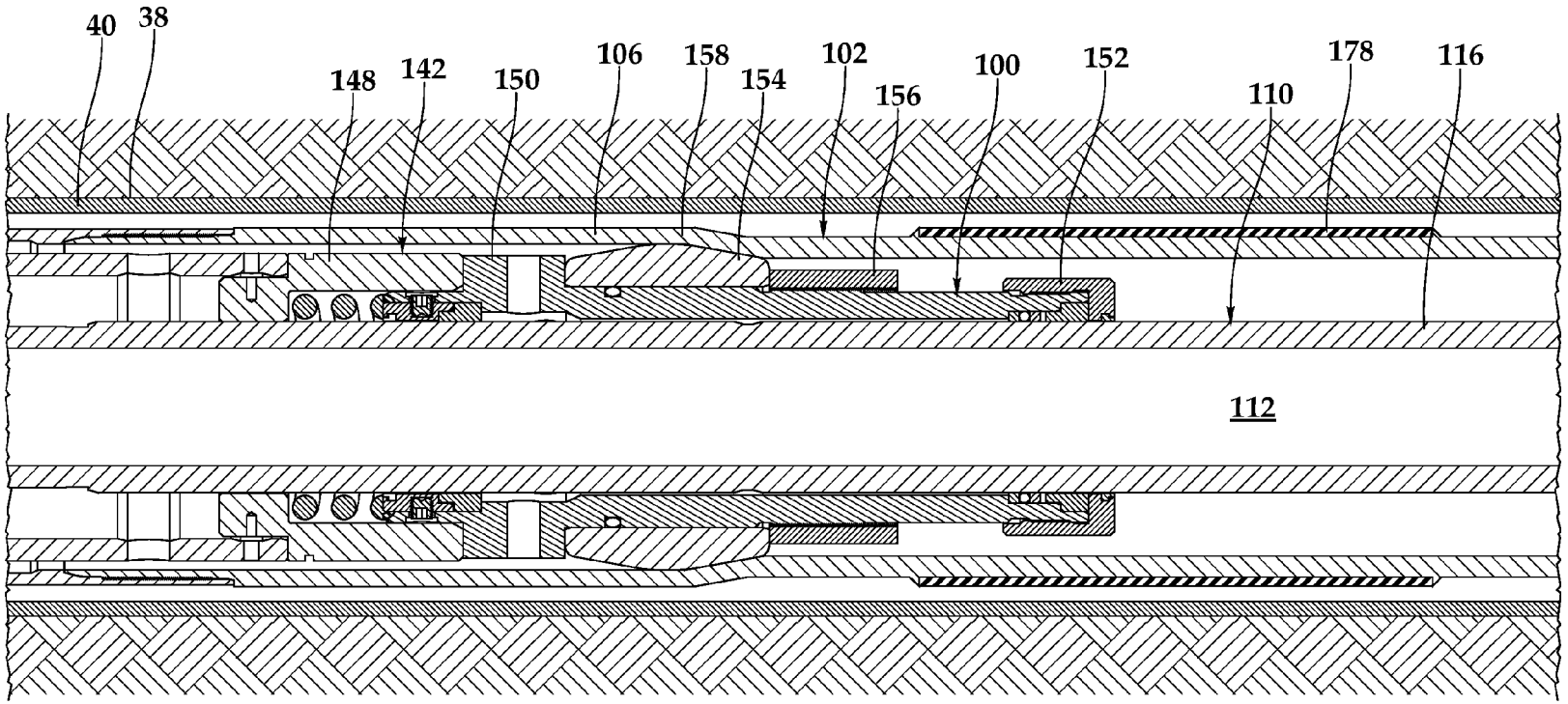
Figure 2F:
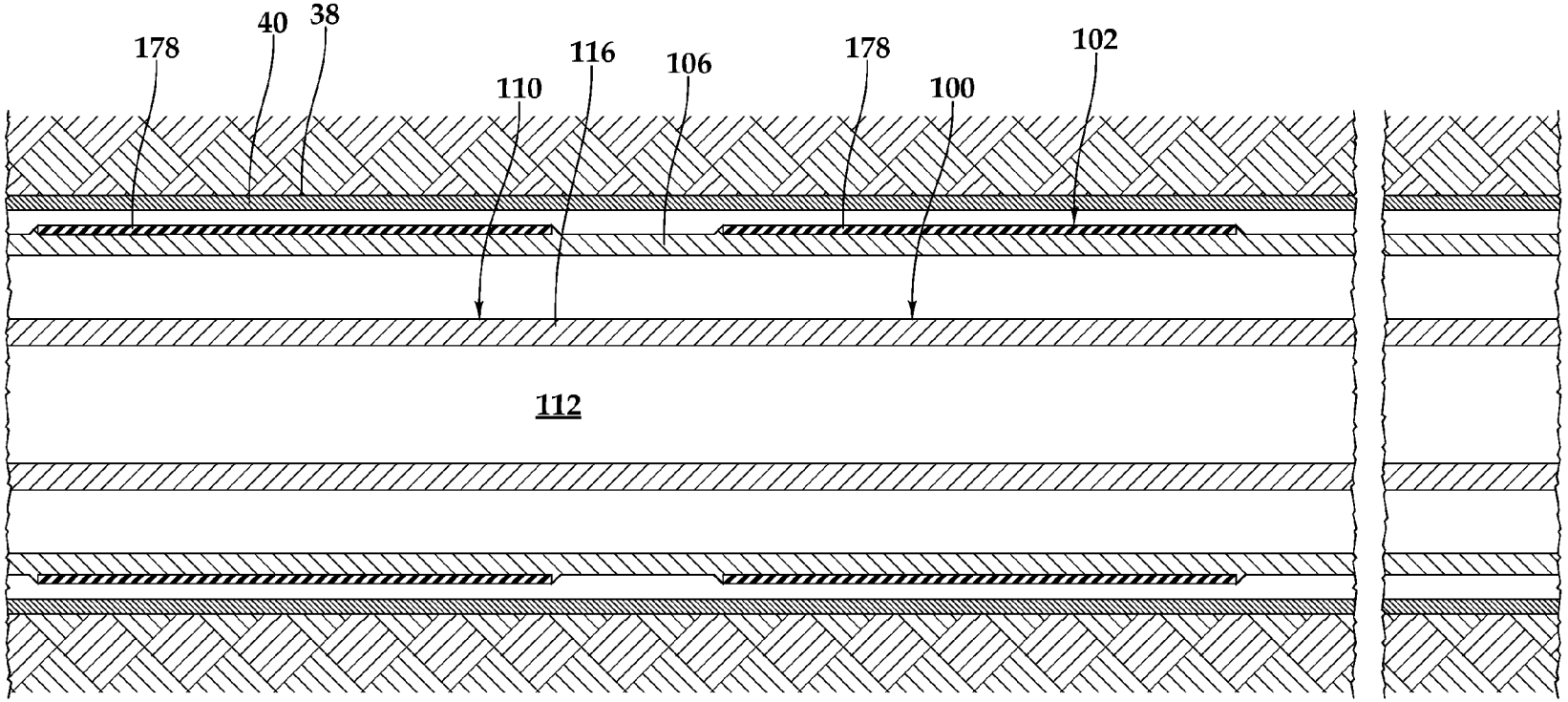
Figure 2G:
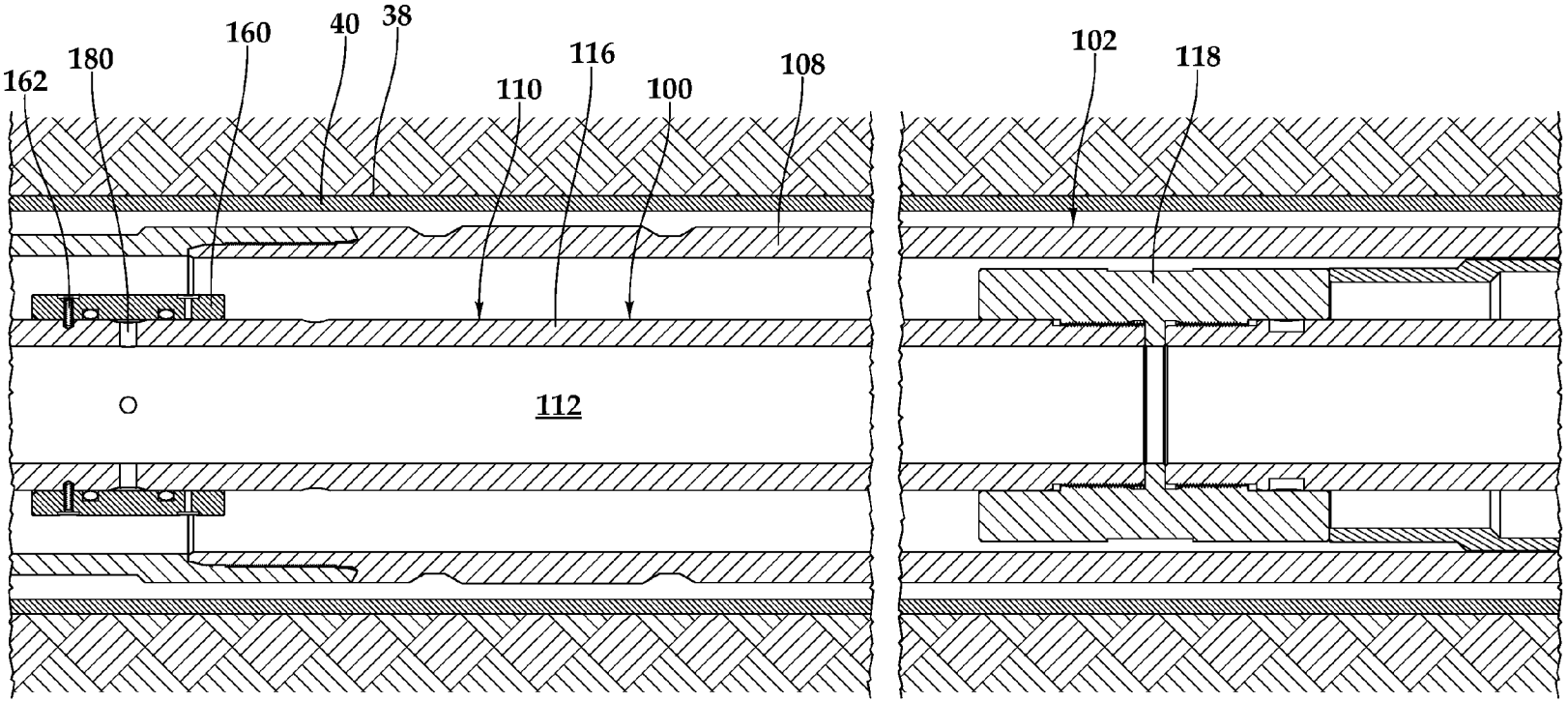
Figure 2H:
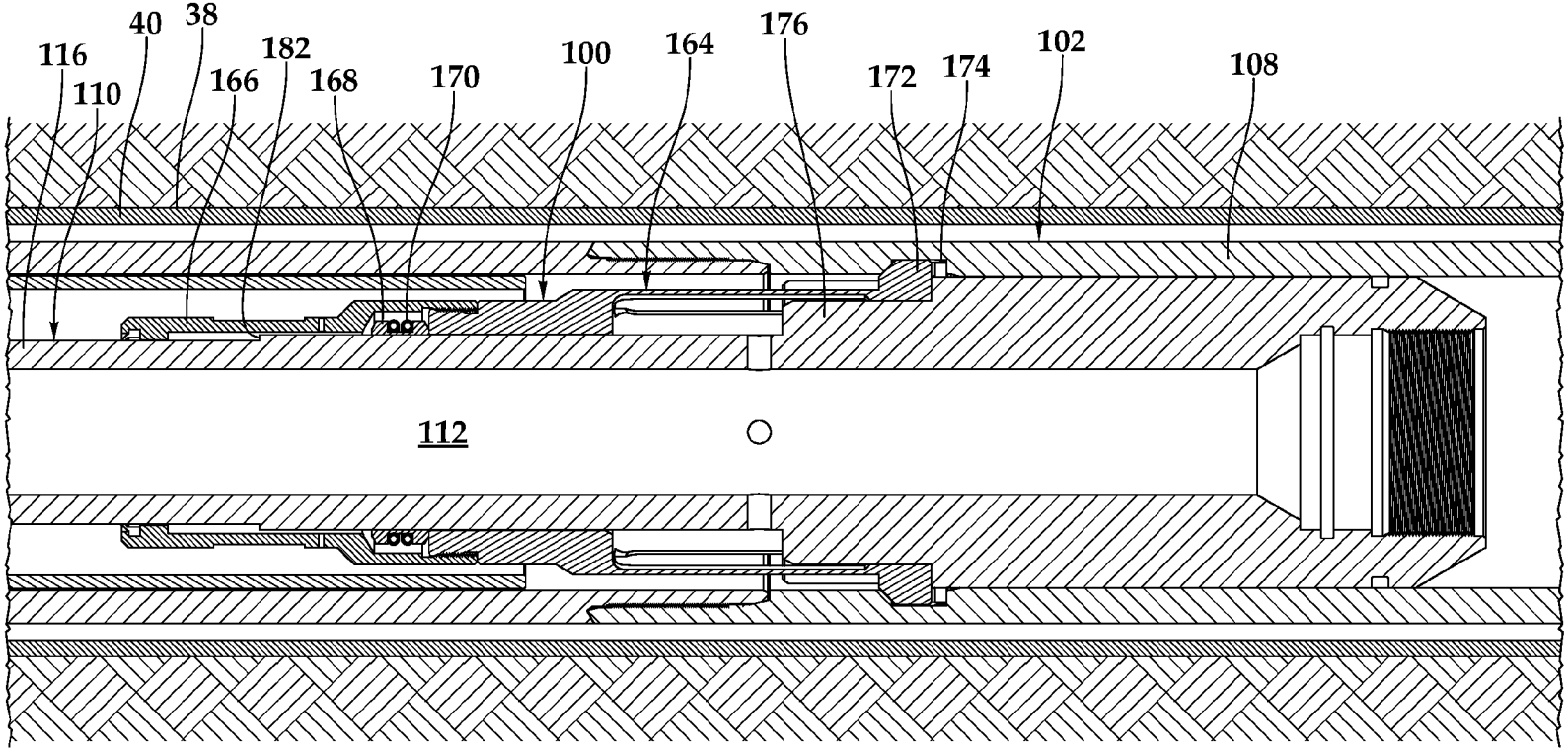

Referring initially to FIG. 1, an apparatus for installing a liner string in a casing string previously installed in a subterranean wellbore being deployed from an offshore oil or gas platform is schematically illustrated and generally designated 10. A semi-submersible platform 12 is centered over submerged oil and gas formation 14 located below sea floor 16. A subsea conduit 18 extends from deck of platform 12 to wellhead installation 22, including blowout preventers 24. Platform 12 has a hoisting apparatus 26, a derrick 28, a travel block 30, a hook 32 and a swivel for raising and lowering pipe strings, such as a liner string 36.

A wellbore 38 extends through the various earth strata including formation 14. An upper portion of wellbore 38 includes casing 40 that is cemented within wellbore 38 by cement 42. Disposed within the lower portion of wellbore 38 is liner string 36. Liner string 36 is being lowered downhole on a work string 44 that includes a setting tool 46 that attaches work string 44 to liner string 36. Liner string 36 includes a liner hanger 48 at its uphole end that is operable to be hydraulically set by passing an expander cone of setting tool 46 through liner hanger 48 to radially expand and plastically deform liner hanger 48 into sealing and gripping engagement with casing string 40.

As shown, liner string 36 is positioned in wellbore 38 such that the downhole end 50 of liner string 36 extends to close proximity to the bottom 52 of wellbore 38. This is achieved without risk of prematurely setting liner hanger 48 within casing string 40 using the various embodiments of the present invention as described in greater detail below.

Even though FIG. 1 depicts a slanted wellbore, it should be understood by those skilled in the art that the apparatus for installing a liner string in a casing string previously installed in a subterranean wellbore of the present invention is equally well suited for use in wellbores having other orientations including vertical wellbores, horizontal wellbores, multilateral wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the uphole direction being toward the top or the left of the corresponding figure and the downhole direction being toward the bottom or the right of the corresponding figure. Also, even though FIG. 1 depicts an offshore operation, it should be understood by those skilled in the art that the apparatus for installing a liner string in a casing string previously installed in a subterranean wellbore of the present invention is equally well suited for use in onshore operations.

Referring next to FIGS. 2A-2H, therein is depicted an apparatus or setting tool 100 for installing a liner string in a casing string 40 previously installed in a subterranean wellbore 38. Apparatus 100 is used to run a liner string 102 downhole. Liner string 102 includes a plurality of substantially tubular sections that are preferably formed from jointed tubulars that are threadably coupled together at the surface. In the illustrated embodiment, liner string 102 includes a tie back receptacle 104, a liner hanger 106 and any desired number of liner tubulars 108 such that liner string 102 will extend past the end of casing string 40 and substantially to the bottom of wellbore 38.

Apparatus 100 is positioned at least partially within liner string 102 and is operable to transport, apply downward force on and set liner string 102 in the well. Apparatus 100 includes a plurality of substantially tubular members that may be referred to as a tubular mandrel subassembly 110 that cooperate together to form a central bore 112 extending throughout. Tubular mandrel subassembly 110 includes an upper body 114 that may be threadably and sealingly coupled to other components of the work string at its upper end. Upper body 114 is slidably and sealing coupled to an inner mandrel assembly 116 that extends to the lower end of apparatus 100. Inner mandrel assembly 116 is formed from a plurality of sections that are threadably and sealingly coupled together by connectors 118. Inner mandrel assembly 116 may be threadably and sealingly coupled to other components of the work string at its lower end. An outer sleeve 120 is threadably coupled to upper body 114 and includes a lower receiver 122 that is positioned around inner mandrel assembly 116. Upper body 114 includes a plurality of lugs 124 that cooperate with a slot profile 126 of inner mandrel assembly 116.

Setting tool 100 has a release subassembly 128 including a prop sleeve 130 that is secured to an outer mandrel extension 132 by a plurality of shear pins 134. Outer mandrel extension 132 is securably coupled to inner mandrel assembly 116 by a plurality of dogs 136. Outer mandrel extension 132 is threadably coupled to outer mandrel 138 which is sealing received within tie back receptacle 104. A load transfer subassembly depicted as a ring 140 having shearable threads is threadably positioned about outer mandrel 138 and against the top of tie back receptacle 104.

Setting tool 100 has an expansion cone drive subassembly 142 that includes a piston 144, a drive sleeve 146, a support ring 148, a support sleeve 150, an end cap 152, an expansion cone 154 and a shoe 156. Expansion cone 154 has a frustoconical shape having a smallest outer diameter that is smaller than the inner diameter of liner hanger 106 and a largest outer diameter that is larger than the inner diameter of liner hanger 106. Expansion cone 154 is initially received in a cone launcher portion 158 of liner hanger 106, where the inner diameter of liner hanger 106 is large enough to accept expansion cone 154 without having been radially expanded. A bypass sleeve 160 is securably connected to inner mandrel assembly 116 by one or more shear pins 162.

Setting tool 100 has a collet subassembly 164 that includes a retainer 166, dogs 168, a garter spring 170 and a collet assembly 172. Collet assembly 172 cooperates with a mating profile 174 of liner string 102 and is supported within mating profile 174 by a radially expanded portion or prop 176 of inner mandrel assembly 116.

Figure 3:
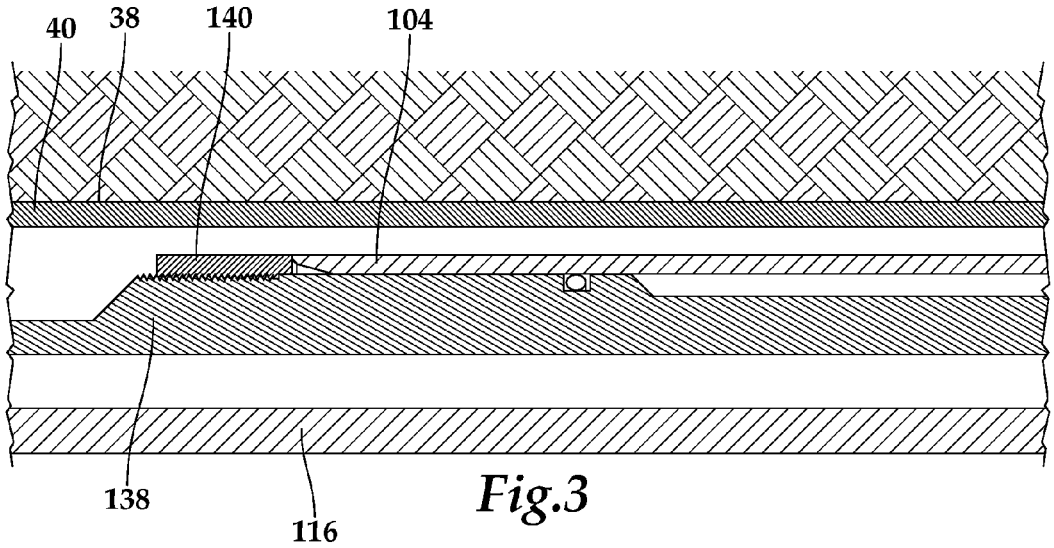
FIG. 3 is a cross sectional view of a portion of an apparatus for installing a liner string in a casing string previously installed in a subterranean wellbore including a load transfer subassembly according to an embodiment of the present invention.

In operation, setting tool 100 is used to install liner string 102 in casing string 40. Importantly, this is achieved without risk of prematurely setting liner hanger 106 within casing string 40 due to the use of load transfer subassembly 140 that is operable to transmit the required force in the downhole direction to work liner string 102 to the bottom of wellbore 38. The use of load transfer subassembly 140 prevents the application of a significant force between expansion cone 154 and cone launcher portion 158, thereby preventing expansion of and premature setting of liner hanger 106. In the illustrated embodiment, as liner string 102 is being run downhole via work string 44, significant force may be required to push liner string 102 to its desired location, particularly in deviated, horizontal or multilateral wellbores. The force from the surface is applied through work string 44 to upper body 114. In the running configuration of setting tool 100, upper body 114 applies the downward force to inner mandrel assembly 116 via lugs 124 and slot profile 126. This downhole force is transferred from inner mandrel assembly 116 to outer mandrel 138 via dogs 136 and outer mandrel extension 132. The downhole force is then applied from outer mandrel 138 to tie back receptacle 104 of liner string 102 via load transfer subassembly 140, as best seen in FIG. 3. Accordingly, the downhole force from work string 44 is applied to liner string 102 by load transfer subassembly 140 on tie back receptacle 104 without application of a downhole force by expansion cone 154.

Once liner string 102 is positioned in the desired location in wellbore 38, liner hanger 106 may be expanded. To expand liner hanger 106, expansion cone 154 is driven downhole from cone launcher portion 158 through liner hanger 106 by the expansion cone drive subassembly 142. As expansion cone 150 passes through liner hanger 106 it radially expands and plastically deforms liner hanger 106. In certain instances, expansion cone 150 may be sized to radially expand and plastically deform liner hanger 106 such that the outer diameter of liner hanger 106 is pressed into gripping and sealing engagement with casing string 40. In the illustrated embodiment, liner hanger 106 includes a plurality of circumferential seals 178 to facilitate achieving a seal with casing string 40.

As discussed above, expansion cone drive subassembly 142 includes drive sleeve 146 that drives expansion cone 154 through liner hanger 106. The uphole end of drive sleeve 146 initially abuts outer mandrel 138 that supports drive sleeve 146 against moving uphole relative to the inner mandrel assembly 116. Outer mandrel 138 is affixed to inner mandrel assembly 216 by dogs 136 via outer mandrel extension 132.

In the illustrated embodiment, drive sleeve 146 carries a single piston 144 that seals against inner mandrel assembly 116. Those skilled in the art will recognize that addition pistons could be used to multiply the hydraulic force applied to drive sleeve 146. Pressure applied to piston 144 moves drive sleeve 146 and thus expansion cone 154 downhole. At the bottom of its stroke, expansion cone drive subassembly 142 impacts bypass sleeve 160 carried on inner mandrel assembly 116 causing shear pins 162 to shear and opening bypass ports 180 in inner mandrel assembly 116 equalizing pressure on piston 144.

After expanding liner hanger 106, setting tool 100 can be decoupled from liner string 102 and retrieved to the surface. As described above, force in the downhole direction applied from work string 44 is transferred to load transfer subassembly 140 which abuts tie back receptacle 104. In the illustrated embodiment, load transfer subassembly 140 is a ring that has shearable threads. Sufficient force in the downhole direction will cause the threads to shear off the ring which allows relative movement between mandrel subassembly 110 and liner string 102. Shifting of mandrel subassembly 110 downhole relative to liner string 102 unprops collet assembly 172 allowing collet assembly 172 to retract inward and release from mating profile 174, thereby releasing setting tool 100 from liner string 102. Thereafter, setting tool 100 may be withdrawn uphole from liner string 102 and out of the wellbore.

More specifically, collet assembly 172 is radially supported into engagement with mating profile 174 via prop 176 during run in and expansion. Collet assembly 172 is released from engagement with mating profile 174 by moving prop 176 downhole relative to collet assembly 172. Further downhole movement of inner mandrel assembly 116 relative to collet subassembly 164 allows dogs 168 to retract into the radially reduced portion of inner mandrel assembly 116 due to the bias force of garter spring 170. Collet assembly 172 is prevented from shifting back downhole and reengaging with mating profile 174 as dogs 168 are prevented from moving past shoulder 182 by garter spring 170. In this configuration, setting tool 100 may be withdrawn uphole from liner string 102 and out of the wellbore.

Alternatively, setting tool 100 may be released from liner string 102 without shearing load transfer subassembly 140 or prior to operating drive subassembly 142, if required. Specifically, application of a torsional force followed by application of a downhole force release inner mandrel assembly 116 from liner string 102. Upper body 114 has inwardly protruding lugs 124 that operate within slot profile 126 of inner mandrel assembly 116. Slot profile 126 includes a plurality of slot pairs, each consisting of a long slot and a short slot of the type known to those skilled in the art as J-slots. The short slots of slot profile 126 define upper receptacles 184 and the long slots of slot profile 126 define lower receptacles 186. In the running configuration, lugs 124 are received in respective upper receptacles 184 and are operable to transmit a force in the downhole direction to inner mandrel assembly 116. When it is desired to decouple setting tool 100 from liner string 102, rotating upper body 114 dislodges lugs 124 from upper receptacles 184 and allows upper body 114 to move downhole relative to inner mandrel assembly 116 while lugs 124 traverse the long slots until received in respective lower receptacles 186.

When upper body 114 moves downhole relative to the inner mandrel assembly 116, it releases the inner mandrel assembly 116 from outer mandrel extension 132. As upper body 114 moves downhole, lower receiver 122 contacts release subassembly 128 and shears shear pins 134 retaining prop sleeve 130 to outer mandrel extension 132. Prop sleeve 130 supports dogs 136 that engage inner mandrel assembly 116 and affix outer mandrel assembly 132 relative to inner mandrel assembly 116. Thus, when desupported, dogs 136 release from inner mandrel assembly 116 and allow inner mandrel assembly 116 to move relative to release subassembly 128.

After inner mandrel assembly 116 is released from outer mandrel extension 132, upper body 114 acts upon inner mandrel assembly 116 to drive inner mandrel assembly 116 downhole relative to liner string 102. Driving inner mandrel assembly 116 downhole relative to liner hanger 102 moves prop 176 out of engagement with collet assembly 172, as described above, such that setting tool 100 may be withdrawn uphole from liner string 102 and out of the wellbore.

Figure 4:
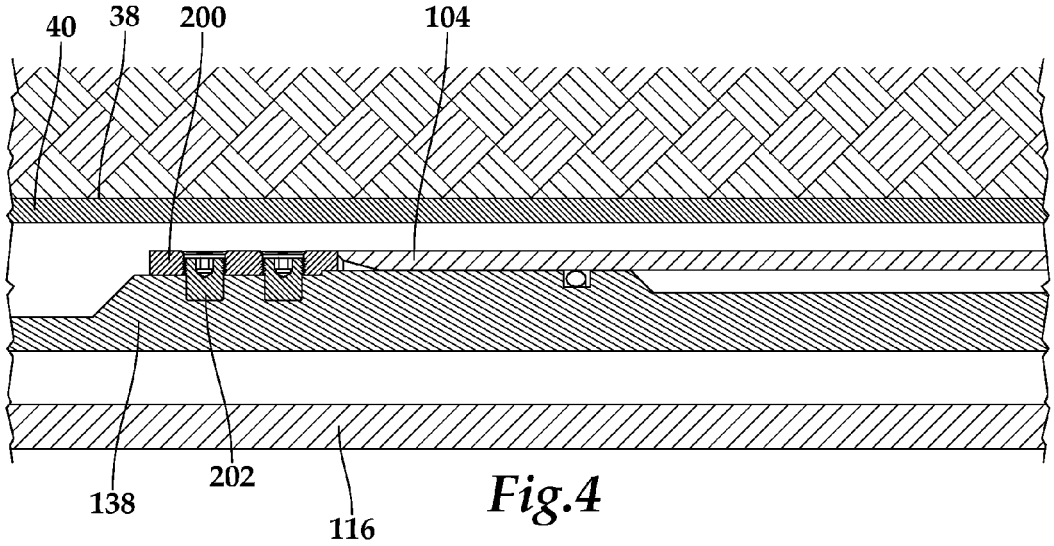
FIG. 4 is a cross sectional view of a portion of an apparatus for installing a liner string in a casing string previously installed in a subterranean wellbore including a load transfer subassembly according to an embodiment of the present invention.

Referring next to FIG. 4, therein is depicted a portion of an apparatus for installing a liner string in a casing string previously installed in a subterranean wellbore. A load transfer subassembly 200 is depicted as a ring coupled to outer mandrel 138 via a plurality of shear pins 202. Similar to load transfer subassembly 140 of FIGS. 2 and 3, load transfer subassembly 200 is operable to transmit a downward force to tie back receptacle 104 of liner string 102 to work liner string 102 to the bottom of wellbore 38 without application of a downhole force by expansion cone 154, thereby without the risk of prematurely setting liner hanger 106.

After positioning liner string 102 in the desired location and expanding liner hanger 106, setting tool 100 can be decoupled from liner string 102 and retrieved to the surface. A force in the downhole direction applied from work string 44 is transferred to load transfer subassembly 200 which abuts tie back receptacle 104. Sufficient force in the downhole direction will cause shear pins 202 to shear which allows relative movement between mandrel subassembly 110 and liner string 102 causing collet assembly 172 to retract inward and release from mating profile 174, as described above, thereby releasing setting tool 100 from liner string 102 and allowing retrieval to the surface.

Figure 5:
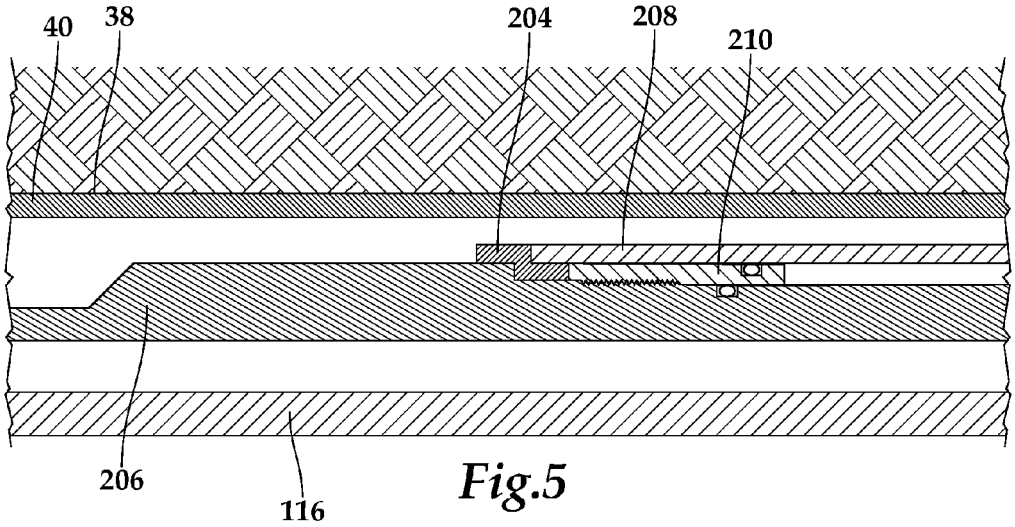
FIG. 5 is a cross sectional view of a portion of an apparatus for installing a liner string in a casing string previously installed in a subterranean wellbore including a load transfer subassembly according to an embodiment of the present invention.

Referring next to FIG. 5, therein is depicted a portion of an apparatus for installing a liner string in a casing string previously installed in a subterranean wellbore. A load transfer subassembly 204 is depicted as a shear sleeve and is positioned between outer mandrel 206 and tie back receptacle 208. Load transfer subassembly 204 is supported by retaining sleeve 210 that is threadably coupled to outer mandrel 206. Similar to the load transfer subassemblies described above, load transfer subassembly 204 is operable to transmit a downward force to tie back receptacle 208 of liner string 102 to work liner string 102 to the bottom of wellbore 38 without application of a downhole force by expansion cone 154, thereby without the risk of prematurely setting liner hanger 106.

After positioning liner string 102 in the desired location and expanding liner hanger 106, setting tool 100 can be decoupled from liner string 102 and retrieved to the surface. A force in the downhole direction applied from work string 44 is transferred to load transfer subassembly 204 which abuts tie back receptacle 208. Sufficient force in the downhole direction will cause load transfer subassembly 204 to shear between its radially inward and radially outward portions which allows relative movement between mandrel subassembly 110 and liner string 102 causing collet assembly 172 to retract inward and release from mating profile 174, as described above, thereby releasing setting tool 100 from liner string 102 and allowing retrieval to the surface.

Figure 6:
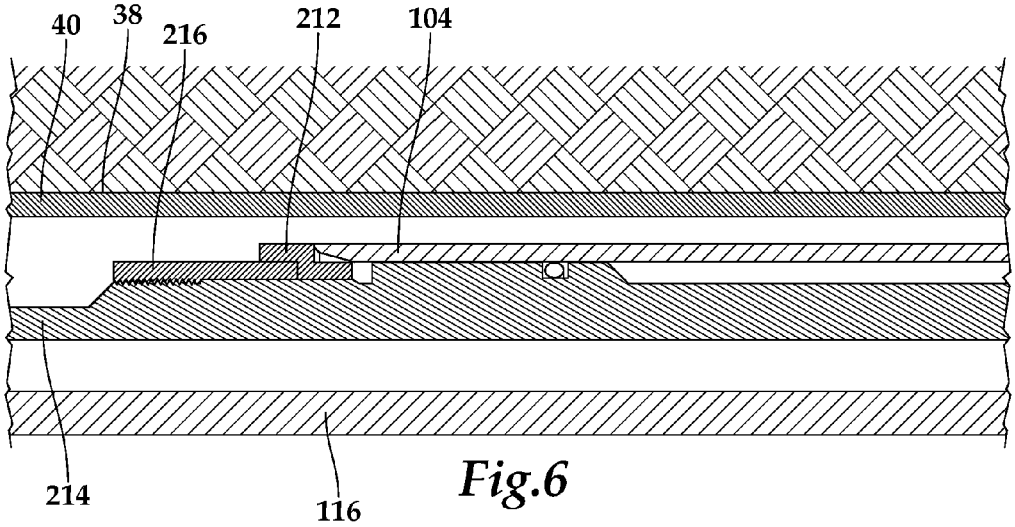
FIG. 6 is a cross sectional view of a portion of an apparatus for installing a liner string in a casing string previously installed in a subterranean wellbore including a load transfer subassembly according to an embodiment of the present invention.

Referring next to FIG. 6, therein is depicted a portion of an apparatus for installing a liner string in a casing string previously installed in a subterranean wellbore. A load transfer subassembly 212 is depicted as a shear sleeve and is positioned between outer mandrel 214 and tie back receptacle 104. Load transfer subassembly 212 is supported by retaining sleeve 216 that is threadably coupled to outer mandrel 214. Similar to the load transfer subassemblies described above, load transfer subassembly 212 is operable to transmit a downward force to tie back receptacle 104 of liner string 102 to work liner string 102 to the bottom of wellbore 38 without application of a downhole force by expansion cone 154, thereby without the risk of prematurely setting liner hanger 106.

After positioning liner string 102 in the desired location and expanding liner hanger 106, setting tool 100 can be decoupled from liner string 102 and retrieved to the surface. A force in the downhole direction applied from work string 44 is transferred to load transfer subassembly 212 which abuts tie back receptacle 104. Sufficient force in the downhole direction will cause load transfer subassembly 212 to shear between its radially inward and radially outward portions which allows relative movement between mandrel subassembly 110 and liner string 102 causing collet assembly 172 to retract inward and release from mating profile 174, as described above, thereby releasing setting tool 100 from liner string 102 and allowing retrieval to the surface.

Figure 7:
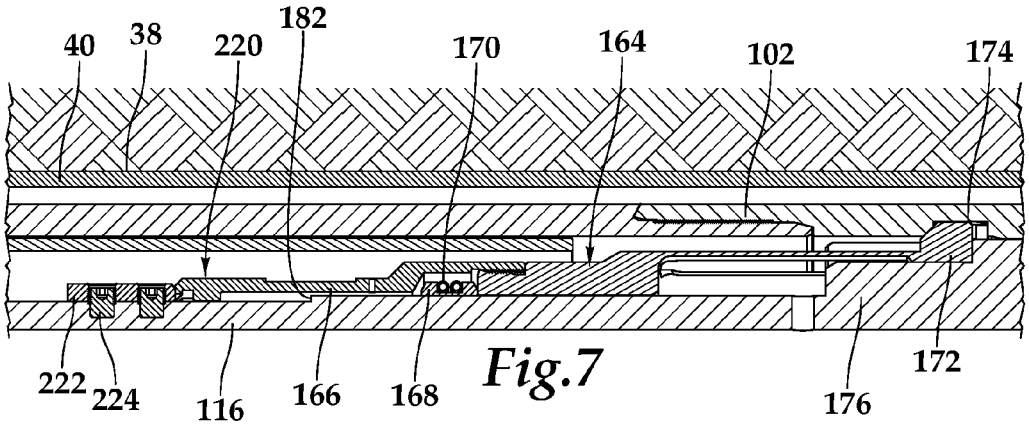
FIG. 7 is a cross sectional view of a portion of an apparatus for installing a liner string in a casing string previously installed in a subterranean wellbore including a load transfer subassembly according to an embodiment of the present invention.

Referring next to FIG. 7, therein is depicted a portion of an apparatus for installing a liner string in a casing string previously installed in a subterranean wellbore. A load transfer subassembly 220 is depicted as a combination of a ring 222 that is coupled to inner mandrel subassembly 116 via a plurality of shear pins 224 and collet subassembly 164. Compared to the load transfer subassemblies discussed above, load transfer subassembly 220 has been relocated from a position wherein the downhole force is applied to tie back receptacle 104 of liner sting 102 to a position wherein the downhole force is applied to mating profile 174 of liner string 102. More specifically, the force from the surface is applied through work string 44 to upper body 114. Upper body 114 applies the downward force to inner mandrel assembly 116 via lugs 124 and slot profile 126. This downhole force is transferred from inner mandrel assembly 116 to collet subassembly 164 via ring 222. The force is transferred through collet subassembly 164 to liner string 102 via the contact between collet assembly 172 and mating profile 174. Accordingly, the downhole force from work string 44 is applied to liner string 102 by load transfer subassembly 220 without application of a downhole force by expansion cone 154, thereby without the risk of prematurely setting liner hanger 106.

After positioning liner string 102 in the desired location and expanding liner hanger 106, setting tool 100 can be decoupled from liner string 102 and retrieved to the surface. A force in the downhole direction applied from work string 44 is transferred to ring 222 which abuts collet subassembly 164. Sufficient force in the downhole direction will cause shear pins 224 to shear which allows relative movement between mandrel subassembly 110 and liner string 102 causing collet assembly 172 to retract inward and release from mating profile 174, as described above, thereby releasing setting tool 100 from liner string 102 and allowing retrieval to the surface.

Figure 8:
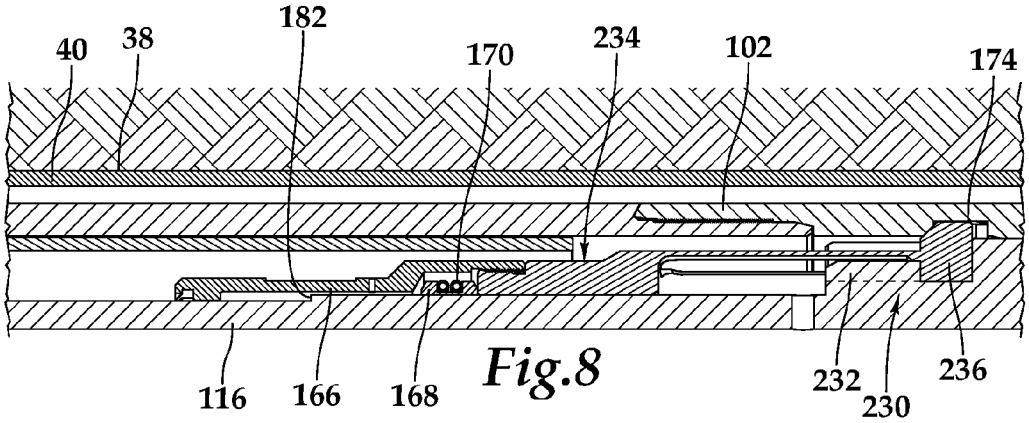
FIG. 8 is a cross sectional view of a portion of an apparatus for installing a liner string in a casing string previously installed in a subterranean wellbore including a load transfer subassembly according to an embodiment of the present invention.

Referring next to FIG. 8, therein is depicted a portion of an apparatus for installing a liner string in a casing string previously installed in a subterranean wellbore. A load transfer subassembly 230 is depicted as a combination of a slotted prop 232 and collet assembly 236 of collet subassembly 234. Similar to load transfer subassembly 220, load transfer subassembly 230 applies the downhole force to mating profile 174 of liner string 102. More specifically, the force from the surface is applied through work string 44 to inner mandrel assembly 116 via upper body 114. This downhole force is transferred from inner mandrel assembly 116 to collet assembly 236 via slotted prop 232. The force is transferred to liner string 102 via contact between collet assembly 172 and mating profile 174. Accordingly, the downhole force from work string 44 is applied to liner string 102 by load transfer subassembly 230 without application of a downhole force by expansion cone 154, thereby without the risk of prematurely setting liner hanger 106.

After positioning liner string 102 in the desired location and expanding liner hanger 106, setting tool 100 can be decoupled from liner string 102 and retrieved to the surface. This is achieved by rotation of inner mandrel assembly 116 relative to liner string 102 which rotates slotted prop 232 relative to collet assembly 236 which allows relative axial movement between mandrel subassembly 110 and liner string 102 causing collet assembly 236 to retract inward and release from mating profile 174, as described above, thereby releasing setting tool 100 from liner string 102 and allowing retrieval to the surface.

Figure 9:
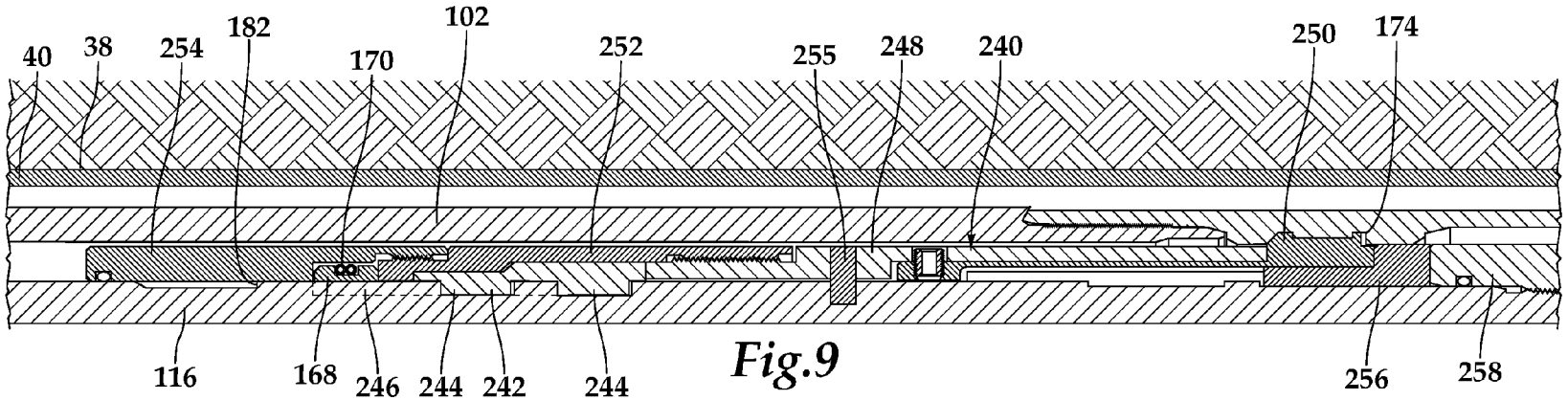
FIG. 9 is a cross sectional view of a portion of an apparatus for installing a liner string in a casing string previously installed in a subterranean wellbore including a load transfer subassembly according to an embodiment of the present invention.

Referring next to FIG. 9, therein is depicted a portion of an apparatus for installing a liner string in a casing string previously installed in a subterranean wellbore. A load transfer subassembly 240 is depicted as a combination of a ring 242 having lugs 244 that cooperate with a slotted profile 246 of inner mandrel assembly 116, a load transfer sleeve 248 and a collet assembly 250. A retainer 252 is threadably coupled to load transfer sleeve 248 and supports ring 242 within slotted profile 246. A retainer extension 254 is threadably coupled to retainer 252. Relative rotation between load transfer subassembly 240 and inner mandrel assembly 116 is initially prevented by one or more shear pins 255. A prop 256 initially supports collet assembly 250 within mating profile 174. A prop retainer 258 is threadably coupled to inner mandrel assembly 116 and prevents axial movement of prop 256.

Similar to load transfer subassembly 220, load transfer subassembly 240 applies the downhole force to mating profile 174 of liner string 102. More specifically, the force from the surface is applied through work string 44 to inner mandrel assembly 116 via upper body 114. This downhole force is transferred from inner mandrel assembly 116 to collet assembly 250 via ring 242 and a load transfer sleeve 248. The force is transferred from collet assembly 250 to liner string 102 via contact between collet assembly 250 and mating profile 174. Accordingly, the downhole force from work string 44 is applied to liner string 102 by load transfer subassembly 240 without application of a downhole force by expansion cone 154, thereby without the risk of prematurely setting liner hanger 106.

After positioning liner string 102 in the desired location and expanding liner hanger 106, setting tool 100 can be decoupled from liner string 102 and retrieved to the surface. This is achieved by rotation of inner mandrel assembly 116 relative to load transfer subassembly 240. Sufficient torsional force will cause shears pins 255 to shear which rotates slotted profile 246 of inner mandrel assembly 116 relative to lugs 244 of ring 242 which allows relative axial movement between inner mandrel assembly 116 and liner string 102 causing collet assembly 250 to retract inward and release from mating profile 174, as described above, thereby releasing setting tool 100 from liner string 102 and allowing retrieval to the surface.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for installing a liner string in a wellbore casing, the method comprising:

providing a setting tool having an expansion cone subassembly disposed within the liner string and a load transfer subassembly in contact with a shoulder of the liner string;

lowering the setting tool and the liner string into the wellbore casing;

applying a force in the downhole direction on the shoulder of the liner string with the load transfer subassembly to push the liner string in the downhole direction to a desired location relative to the wellbore casing;

axially moving the expansion cone subassembly through the liner string to radially expand at least a portion of the liner string into contact with the wellbore casing; and decoupling the load transfer subassembly from the setting tool.

2. The method as recited in claim 1 wherein applying a force in the downhole direction to the liner string with the load transfer subassembly further comprises applying the force in the downhole direction to the liner string with a ring operably associated with the setting tool.

3. The method as recited in claim 1 wherein applying a force in the downhole direction to the liner string with the load transfer subassembly further comprises applying the force in the downhole direction to the liner string with a sleeve operably associated with the setting tool.

4. The method as recited in claim 1 wherein applying a force in the downhole direction to the liner string with the load transfer subassembly further comprises applying the force in the downhole direction to the liner string with a collet subassembly operably associated with the setting tool.

5. The method as recited in claim 1 wherein decoupling the load transfer subassembly from the setting tool further comprises shearing a plurality of threads coupling the load transfer subassembly to the setting tool.

6. The method as recited in claim 1 wherein decoupling the load transfer subassembly from the setting tool further comprises shearing a plurality of pins coupling the load transfer subassembly to the setting tool.

7. The method as recited in claim 1 wherein decoupling the load transfer subassembly from the setting tool further comprises shearing a sleeve operably positioned between the setting tool and the liner string.

8. The method as recited in claim 1 wherein decoupling the load transfer subassembly from the setting tool further comprises rotating a slotted assembly.

9. The method as recited in claim 1 wherein axially moving the expansion cone subassembly through the liner string to radially expand at least a portion of the liner string into contact with the wellbore casing further comprises radially expanding a liner hanger into contact with the wellbore casing.

10. An apparatus for installing a liner string having a shoulder in a wellbore casing, the apparatus comprising:

a tubular mandrel subassembly;

a load transfer subassembly carried on the tubular mandrel subassembly, the load transfer assembly contacting the shoulder of the liner string to apply a force in the downhole direction to the shoulder of the liner string and to lush the liner string in the downhole direction; and an expander cone subassembly carried on the tubular mandrel subassembly, the expander cone subassembly disposed within the liner string and operable to radially expand at least a portion of the liner string into contact with the wellbore casing when axially moved through the liner string;

wherein decoupling of the load transfer subassembly from the tubular mandrel subassembly enables release of the apparatus from the liner string.

11. The apparatus as recited in claim 10 wherein the load transfer subassembly further comprises a ring shearably coupled to the tubular mandrel subassembly.

12. The apparatus as recited in claim 11 wherein the ring further comprises shearable threads.

13. The apparatus as recited in claim 11 further comprising a plurality of shear pins coupling the ring to the tubular mandrel subassembly.

14. The apparatus as recited in claim 10 wherein the load transfer subassembly further comprises a shearable sleeve operably positionable between the tubular mandrel subassembly and the liner string.

15. The apparatus as recited in claim 10 wherein the load transfer subassembly further comprises a collet assembly.

16. A method for installing a liner string in a wellbore casing, the method comprising:

positioning a setting tool having a load transfer subassembly within the liner string, the load transfer subassembly in contact with a shoulder of the liner string;

lowering the setting tool and the liner string into the wellbore casing;

applying a force in the downhole direction on the shoulder of the liner string with the load transfer subassembly to push the liner string in the downhole direction to a desired location relative to the wellbore casing; and decoupling the load transfer subassembly from the setting tool.

17. The method as recited in claim 16 wherein decoupling the load transfer subassembly from the setting tool further comprises shearing a plurality of threads coupling the load transfer subassembly to the setting tool.

18. The method as recited in claim 16 wherein decoupling the load transfer subassembly from the setting tool further comprises shearing a plurality of pins coupling the load transfer subassembly to the setting tool.

19. The method as recited in claim 16 wherein decoupling the load transfer subassembly from the setting tool further comprises shearing a sleeve operably positioned between the setting tool and the liner string.

20. The method as recited in claim 16 wherein decoupling the load transfer subassembly from the setting tool further comprises rotating a slotted assembly.

* * * * *